US007143543B1

(12) United States Patent
Daniell

(10) Patent No.: US 7,143,543 B1
(45) Date of Patent: Dec. 5, 2006

(54) SELF-SUPPORTING PLANT HOLDER

(76) Inventor: Roger E. Daniell, 820 Joann Dr., Wilmington, IL (US) 60481

( * ) Notice: Subject to any disclaimer, the term of this patent is extended or adjusted under 35 U.S.C. 154(b) by 0 days.

(21) Appl. No.: 11/285,659

(22) Filed: Nov. 23, 2005

(51) Int. Cl.
*A47G 7/00* (2006.01)
*A45F 3/44* (2006.01)

(52) U.S. Cl. ..... 47/39; 47/67; 47/47; 47/41.14; 248/27.8; 248/156; 248/128; 248/530

(58) Field of Classification Search ..... 47/39, 47/67, 4, 66.6, 66.7, 70, 83, 87, 41.14, 44, 47/41.01, 47; 248/27.8, 156, 175, 530, 519, 248/512, 511, 128, 302; D11/143, 144, 150; 211/181.1
See application file for complete search history.

(56) References Cited

U.S. PATENT DOCUMENTS

| | | | | | |
|---|---|---|---|---|---|
| 57,843 | A | * | 9/1866 | Knowles | 368/271 |
| 166,766 | A | * | 8/1875 | Goodspeed | 47/47 |
| 516,259 | A | * | 3/1894 | Brueckner | 248/27.8 |
| 649,874 | A | * | 5/1900 | Payne | 47/41.11 |
| 1,370,122 | A | * | 3/1921 | Knowles | 248/153 |
| 2,075,006 | A | * | 3/1937 | Braun | 248/27.8 |
| D110,144 | S | * | 6/1938 | Goughnour | D11/148 |
| 2,917,868 | A | * | 12/1959 | Presnick | 47/47 |
| 3,119,202 | A | * | 1/1964 | Harders | 47/47 |
| 3,157,001 | A | * | 11/1964 | Vail | 47/47 |
| 4,194,319 | A | | 3/1980 | Crawford | |
| 4,770,303 | A | | 9/1988 | Boyd | |
| 4,991,344 | A | | 2/1991 | Carney | |
| 5,037,049 | A | * | 8/1991 | Funk | 248/165 |
| 5,341,593 | A | | 8/1994 | Foreman | |
| 5,353,570 | A | * | 10/1994 | Cooper, Jr. | 52/653.2 |
| D415,366 | S | | 10/1999 | Walters-Dowding et al. | |
| 6,035,576 | A | | 3/2000 | Bozeman | |
| 6,418,676 | B1 | * | 7/2002 | Olsen et al. | 52/103 |
| 2004/0169121 | A1 | * | 9/2004 | Winn | 248/530 |

FOREIGN PATENT DOCUMENTS

| | | | |
|---|---|---|---|
| JP | 05-68437 | * | 3/1993 |

* cited by examiner

*Primary Examiner*—Andrea M. Valenti

(57) ABSTRACT

An apparatus includes a body that has abutted and rectilinear lower ends that extend upwardly from the ground surface and terminate thereabove. The body has a top portion formed with a top edge of the lower ends and is disposed coplanar therewith. Coextensive support rods are conjoined to the lower ends and the top portion. The support rods are coextensively shaped and confront a length of the body. A base plate is engaged with the lower ends and the ground surface. An anchor rod is conjoined to the base plate and extends vertically down and away therefrom. The anchor rod is nested below the ground surface for maintaining same at a fixed position. The anchor rod has a diameter greater than a diameter of the lower end portions and the support rods respectively. A plant pot has a hook attached thereto that is attachable to the top portion.

9 Claims, 3 Drawing Sheets

SELF-SUPPORTING PLANT HOLDER

CROSS REFERENCE TO RELATED APPLICATIONS

Not applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

This invention relates to plant holders and, more particularly, to a self-supporting plant holder.

2. Prior Art

There are many avid do-it-yourself gardeners and professional landscapers who are constantly striving to obtain the optimum growth from their plants. A particularly attractive addition to any garden is that of brightly and variedly colored flowers. Certain flowers, however, only thrive when planted in a highly controlled soil environment, which is usually only attainable when planting the flower in a pot that has predetermined quantities of minerals, vitamins and fertilizer in the soil. Having a method to aesthetically display such potted plants in an outdoors garden is thus an obvious need of many horticulturists, whether they be professionals or novices.

Display stands for supporting flower pots are known in the art. There are several patents which disclose various stands. On example discloses a flower pot stand which may be readily assembled and disassembled for shipping and storage. The stand comprises an upright tubular member formed in sections having flat plate members secured thereto. A plurality of arms extend radially from the corners of the plates and are rotatably mounted thereon. The assembly including the arms may be revolved bodily with respect to the ground or floor. Also, the arms may be rotatably adjusted with respect to each other. Unfortunately, this example does not readily compensate for instability issues that may arise when the user whishes to only suspend one plant therefrom.

A further prior art example discloses an apparatus for hanging plants, pots or the like. The apparatus is comprised of a hollow center post having modularly pieced components upon which are mounted radially extending arms and legs. A center hub is provided for mounting the radially extending arms and legs to the center post. The center post is adapted for being supported in its upright position by various type means for mounting on the floor, a tree dolly or for mounting directly into the earth. Unfortunately, the mounting means is not sufficient for fixedly securing the apparatus in a ground surface, thus causing the apparatus lean and fall over when uneven amount of weight are distributed thereabout. Furthermore, the complex design of the apparatus makes production and construction thereof more difficult than needs be.

Accordingly, a need remains for a self-supporting plant holder in order to overcome the above-noted shortcomings. The present invention satisfies such a need by providing a self-supporting plant holder that is easy to install and use, is strong and durable in design for extended periods of outdoors use, and has aesthetic appeal. Such a self-supporting plant holder can be utilized by homeowners caring for their gardens or by professional landscapers who are contracted to care for residential, commercial, and industrial property.

BRIEF SUMMARY OF THE INVENTION

In view of the foregoing background, it is therefore an object of the present invention to provide a self-supporting plant holder. These and other objects, features, and advantages of the invention are provided by an apparatus for supporting and displaying an ornamental plant pot above a ground surface.

The apparatus includes a unitary and single body that has directly abutted and confronting lower end portions registered orthogonal to a ground surface. Such lower end portions have rectilinear shapes, extend vertically upwardly from the ground surface, and terminate at a predetermined height thereabove. The body further has a top portion monolithically formed with a top edge of the lower end portions. Such a top portion has a heart shape that extends vertically upwardly from the lower end portions wherein the top portion is disposed coplanar with the lower end portions. The top portion of the body may be provided with an indentation aligned with a centrally registered longitudinal axis of the body. Such an indentation dips downwardly and is coplanar with the lower end portions.

A pair of coextensively shaped support rods are directly conjoined to the lower end portions and the top portion of the body. Such support rods are coextensively shaped and uniformly confront a longitudinal length of the body. The support rods preferably include monolithically formed upper and lower regions. Such lower regions have longitudinal lengths greater than longitudinal lengths of the upper regions. The upper regions are vertically offset from the lower regions wherein the upper regions flange outwardly and away from a top edge of the lower regions. Such upper regions further preferably maintain continuous and uniform contact with the top portion of the body for advantageously and effectively preventing the body from undesirably bowing outwardly and away from the lower end portions when a plant pot is attached to the top portion of the body. The support rods may be permanently welded to the body.

A base plate that has planar top and bottom surfaces is directly engaged with a bottom edge of the lower end portions and the ground surface. An anchor rod is directly conjoined to the bottom surface of the base plate and oriented orthogonal thereto. Such an anchor rod extends vertically down and away from the base plate and is coplanar with the lower end portions of the body. The anchor rod is nested below the ground surface for advantageously and effectively maintaining the body at a fixed position during inclement weather conditions. The anchor rod has a diameter greater than a diameter of the lower end portions and the support rods respectively. A plant pot is included that has a hook directly attached thereto. Such a hook is directly and removably attached to the top portion of the body. The base plate may be modified by drilling holes therein to facilitate anchoring the base plate to a concrete surface via conventional fasteners. This would require removal of its ground stakes. Also, small hooks could be added to a perimeter of to allow smaller plants to be hung from the present invention.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
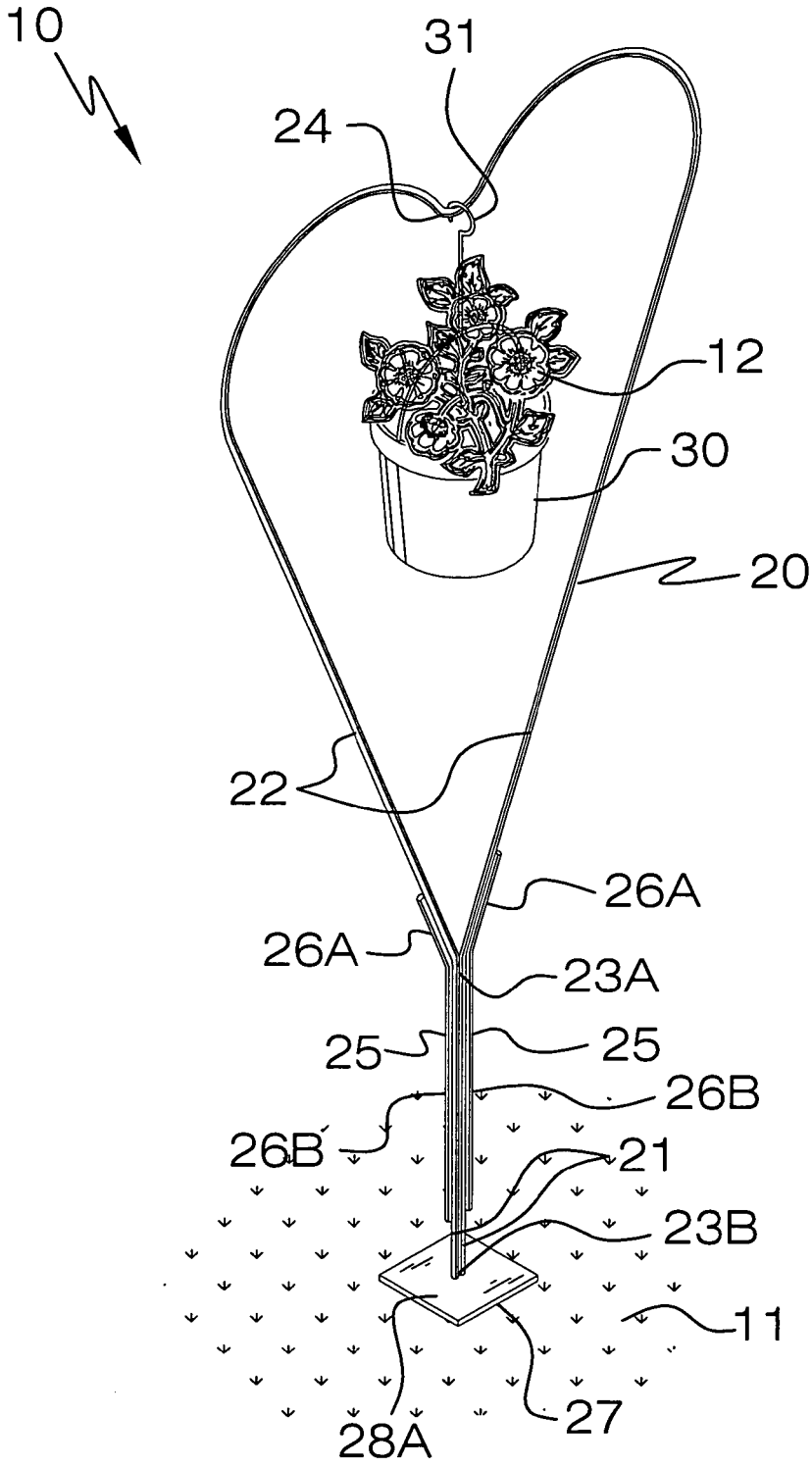
FIG. 1 is a perspective view showing a self-supporting plant holder during operating conditions, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a self-supporting plant holder. It should be understood that the apparatus 10 may be used to support many different types of plants and should not be limited in use to only supporting flowering plants.

Referring initially to FIGS. 1 through 4, the apparatus 10 includes a unitary and single body 20 that has directly abutted, without the use of intervening elements, and confronting lower end portions 21 registered orthogonal to a ground surface 11. Such lower end portions 21 have rectilinear shapes, extend vertically upwardly from the ground surface 11, and terminate at a predetermined height thereabove. The body 20 further has a top portion 22 monolithically formed with a top edge 23A of the lower end portions 21. Such a top portion 22 has a heart shape that extends vertically upwardly from the lower end portions 21 wherein the top portion 22 is disposed coplanar with the lower end portions 21. Of course, the top portion 22 may be produced in a variety of alternate suitable shapes, as is obvious to a person of ordinary skill in the art. The top portion 22 of the body 20 is provided with an indentation 24 aligned with a centrally registered longitudinal axis of the body 20, which is an essential and advantageous feature for allowing an even distribution of weight throughout the body 20 when an item is suspended form the indentation 24. Such an indentation 24 dips downwardly and is coplanar with the lower end portions 21.

Again referring to FIGS. 1 through 4, a pair of coextensively shaped support rods 25 are directly conjoined, without the use of intervening elements, to the lower end portions 21 and the top portion 22 of the body 20. Such support rods 25 are coextensively shaped and uniformly confront a longitudinal length of the body 20. The support rods 25 include monolithically formed upper 26A and lower 26B regions. Such lower regions 26B have longitudinal lengths greater than longitudinal lengths of the upper regions 26A.

The upper regions 26A are vertically offset from the lower regions 26B wherein the upper regions 26A flange outwardly and away from a top edge of the lower regions 26B. Such upper regions 26A further maintain continuous and uniform contact with the top portion 22 of the body 20, which is crucial and advantageous for effectively preventing the body 20 from undesirably bowing outwardly and away from the lower end portions 21 when a plant pot 30 (described herein below) is attached to the top portion 22 of the body 20, which is vital and advantageous for allowing the apparatus 10 to be employed in out of doors settings. The support rods 25 are permanently welded to the body 20.

Still referring to FIGS. 1 through 4, a base plate 27 that has planar top 28A and bottom 28B surfaces is directly engaged, without the use of intervening elements, with a bottom edge 23B of the lower end portions 21 and the ground surface 11. An anchor rod 29 is directly conjoined, without the use of intervening elements, to the bottom surface 28B of the base plate 27 and oriented orthogonal thereto. Such an anchor rod 29 extends vertically down and away from the base plate 27 and is coplanar with the lower end portions 21 of the body 20. The anchor rod 27 is nested below the ground surface 11, which is critical and advantageous for effectively maintaining the body 20 at a fixed position during inclement weather conditions.

Figure 2:
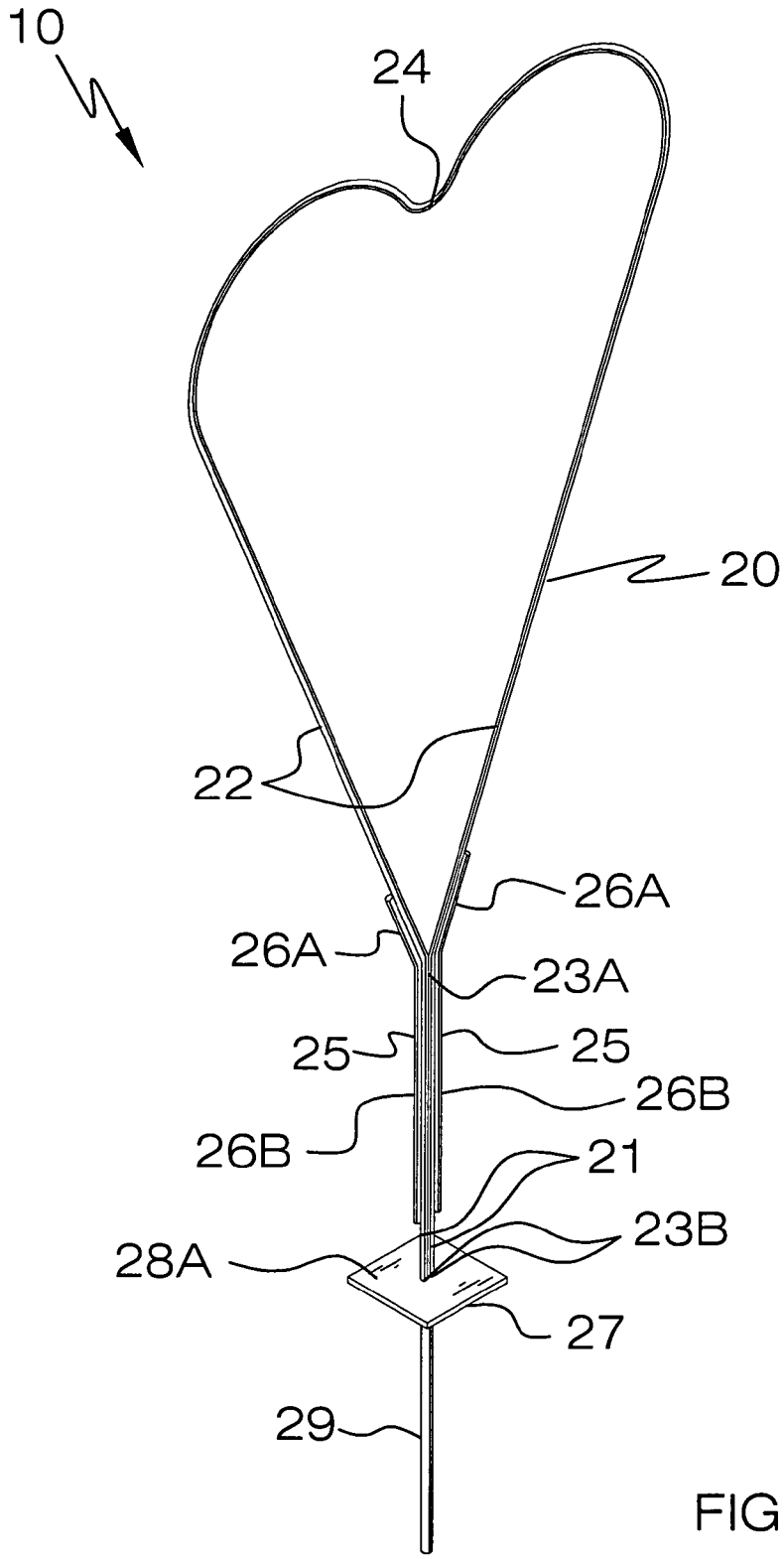
FIG. 2 is a perspective view of the apparatus shown in FIG. 1, showing same removed from the ground surface.
Figure 3:
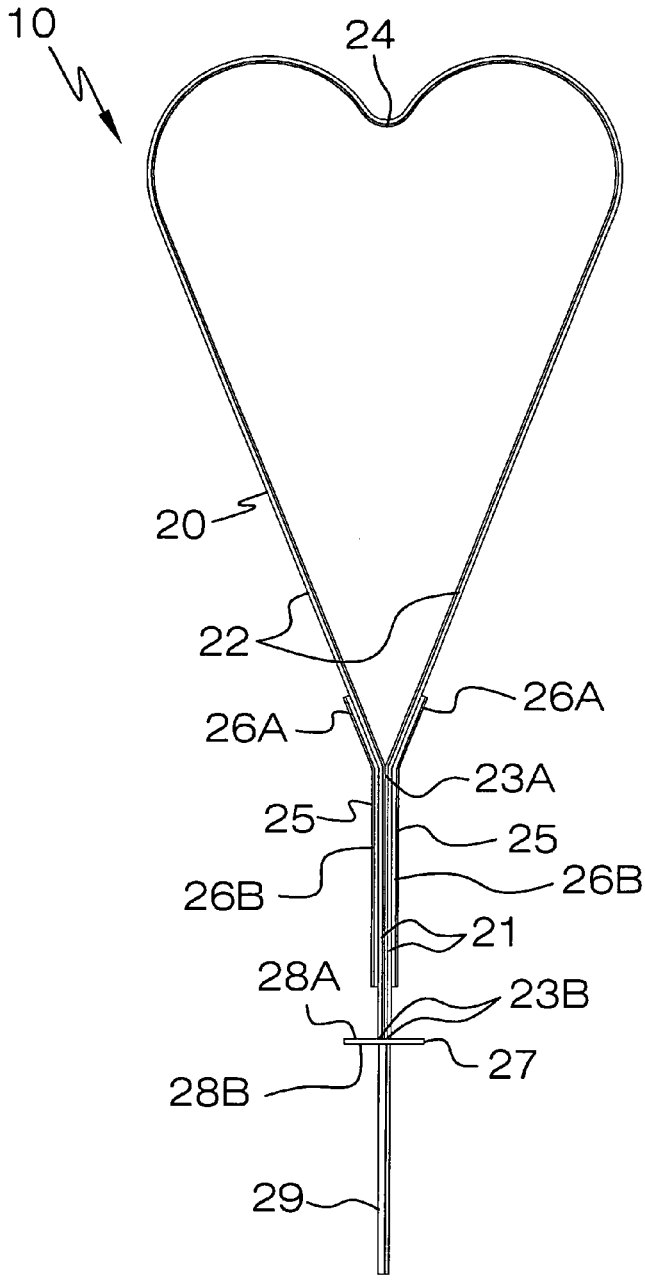
FIG. 3 is a front-elevational view of the apparatus shown in FIG. 2.
Figure 4:
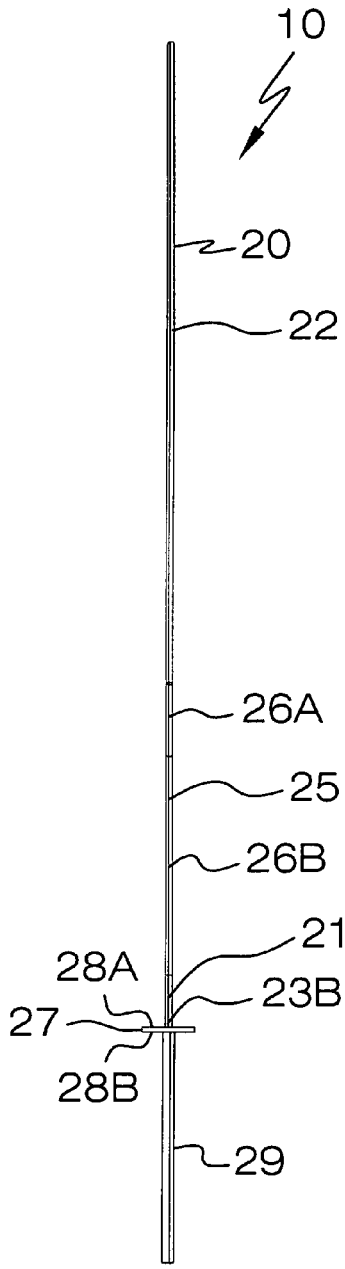
FIG. 4 is a side-elevational view of the apparatus shown in FIG. 3.

The anchor rod 29 has a diameter greater than a diameter of the lower end portions 21 and the support rods 25 respectively, as is best shown in FIGS. 2 through 4. A plant pot 30 is included that has a hook 31 directly attached thereto, without the use of intervening elements, as is illustrated in FIG. 1. Such a hook 31 is directly and removably attached, without the use of intervening elements, to the indentation 24 monolithically formed with top portion 22 of the body 20. A variety of potted plants and flowers 12 may be suspended from the apparatus 10 by means of the plant pot 30. The anchor rod 29 advantageously allows the apparatus 10 to be inserted in virtually any location of a garden, thus allowing the user to place the plant 12 in the most suitable region of the garden for receiving the optimum amount of sunlight and shade during the course of a day. The base plate 27 may be modified by drilling holes therein to facilitate anchoring the base plate to a concrete surface via conventional fasteners. This would require removal of ground stake 29. Also, small hooks could be added to a perimeter of the present invention to allow smaller plants to be hung therefrom.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for supporting and displaying an ornamental plant pot above a ground surface, said apparatus comprising:

a unitary and single body having directly abutted and confronting lower end portions registered orthogonal to a ground surface, said lower end portions having rectilinear shapes and extending vertically upwardly from the ground surface and terminating at a predetermined height thereabove, said body further having a top portion monolithically formed with a top edge of said lower end portions, said top portion having a heart shape and extending vertically upwardly from said lower end portions wherein said top portion is disposed coplanar with said lower end portions;

a pair of coextensively shaped support rods directly conjoined to said lower end portions and said top portion of said body wherein said support rods are coextensively shaped and uniformly confront a longitudinal length of said body;

a base plate having planar top and bottom surfaces directly engaged with a bottom edge of said lower end portions and the ground surface; and an anchor rod directly conjoined to said bottom surface of said base plate and oriented orthogonal thereto, said anchor rod extending vertically down and away from said base plate and being coplanar with said lower end portions of said body, said anchor rod being nested below the ground surface for maintaining said body at a fixed position during inclement weather conditions;

wherein said support rods comprise monolithically formed upper and lower regions, said lower regions having longitudinal lengths greater than longitudinal lengths of said upper regions, said upper regions being vertically offset from said lower regions wherein said upper regions flange outwardly and away from a top edge of said lower regions;

wherein said upper regions maintain continuous and uniform contact with said top portion of said body for preventing said body from undesirably bowing outwardly and away from said lower end portions when a plant pot is attached to said top portion of said body.

2. The apparatus of claim 1, wherein said top portion of said body is provided with an indentation aligned with a centrally registered longitudinal axis of said body, said indentation dipping downwardly and being coplanar with said lower end portions.

3. The apparatus of claim 1, wherein said support rods are permanently welded to said body.

4. An apparatus for supporting and displaying an ornamental plant pot above a ground surface, said apparatus comprising:

a unitary and single body having directly abutted and confronting lower end portions registered orthogonal to a ground surface, said lower end portions having rectilinear shapes and extending vertically upwardly from the ground surface and terminating at a predetermined height thereabove, said body further having a top portion monolithically formed with a top edge of said lower end portions, said top portion having a heart shape and extending vertically upwardly from said lower end portions wherein said top portion is disposed coplanar with said lower end portions;

a pair of coextensively shaped support rods directly conjoined to said lower end portions and said top portion of said body wherein said support rods are coextensively shaped and uniformly confront a longitudinal length of said body;

a base plate having planar top and bottom surfaces directly engaged with a bottom edge of said lower end portions and the ground surface;

an anchor rod directly conjoined to said bottom surface of said base plate and oriented orthogonal thereto, said anchor rod extending vertically down and away from said base plate and being coplanar with said lower end portions of said body, said anchor rod being nested below the ground surface for maintaining said body at a fixed position during inclement weather conditions; and a plant pot having a hook directly attached thereto, said hook being directly and removably attached to said top portion of said body;

wherein said support rods comprise monolithically formed upper and lower regions, said lower regions having longitudinal lengths greater than longitudinal lengths of said upper regions, said upper regions being vertically offset from said lower regions wherein said upper regions flange outwardly and away from a top edge of said lower regions;

wherein said upper regions maintain continuous and uniform contact with said top portion of said body for preventing said body from undesirably bowing outwardly and away from said lower end portions when a plant pot is attached to said top portion of said body.

5. The apparatus of claim 4, wherein said top portion of said body is provided with an indentation aligned with a centrally registered longitudinal axis of said body, said indentation dipping downwardly and being coplanar with said lower end portions.

6. The apparatus of claim 4, wherein said support rods are permanently welded to said body.

7. An apparatus for supporting and displaying an ornamental plant pot above a ground surface, said apparatus comprising:

a unitary and single body having directly abutted and confronting lower end portions registered orthogonal to a ground surface, said lower end portions having rectilinear shapes and extending vertically upwardly from the ground surface and terminating at a predetermined height thereabove, said body further having a top portion monolithically formed with a top edge of said lower end portions, said top portion having a heart shape and extending vertically upwardly from said lower end portions wherein said top portion is disposed coplanar with said lower end portions;

a pair of coextensively shaped support rods directly conjoined to said lower end portions and said top portion of said body wherein said support rods are coextensively shaped and uniformly confront a longitudinal length of said body;

a base plate having planar top and bottom surfaces directly engaged with a bottom edge of said lower end portions and the ground surface;

an anchor rod directly conjoined to said bottom surface of said base plate and oriented orthogonal thereto, said anchor rod extending vertically down and away from said base plate and being coplanar with said lower end portions of said body, said anchor rod being nested below the ground surface for maintaining said body at a fixed position during inclement weather conditions, wherein said anchor rod has a diameter greater than a diameter of said lower end portions and said support rods respectively; and a plant pot having a hook directly attached thereto, said hook being directly and removably attached to said top portion of said body;

wherein said support rods comprise monolithically formed upper and lower regions, said lower regions having longitudinal lengths greater than longitudinal lengths of said upper regions, said upper regions being vertically offset from said lower regions wherein said upper regions flange outwardly and away from a top edge of said lower regions;

wherein said upper regions maintain continuous and uniform contact with said top portion of said body for preventing said body from undesirably bowing outwardly and away from said lower end portions when a plant pot is attached to said top portion of said body.

8. The apparatus of claim 7, wherein said top portion of said body is provided with an indentation aligned with a centrally registered longitudinal axis of said body, said indentation dipping downwardly and being coplanar with said lower end portions.

9. The apparatus of claim 7, wherein said support rods are permanently welded to said body.

* * * * *